US007168248B2

(12) United States Patent
Sakamoto et al.

(10) Patent No.: US 7,168,248 B2
(45) Date of Patent: Jan. 30, 2007

(54) STIRLING ENGINE

(75) Inventors: Jin Sakamoto, Kyoto (JP); Kazushi Yoshimura, Nara (JP); Kenji Takai, Yamatotakada (JP); Shinji Yamagami, Nabari (JP); Yoshiyuki Kitamura, Yamatokoriyama (JP); Hiroshi Yasumura, Nara (JP); Hirotaka Ohno, Ymatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/564,094

(22) PCT Filed: Jul. 20, 2004

(86) PCT No.: PCT/JP2004/010296

§ 371 (c)(1),
(2), (4) Date: Jan. 11, 2006

(87) PCT Pub. No.: WO2005/008149

PCT Pub. Date: Jan. 27, 2005

(65) Prior Publication Data

US 2006/0137339 A1 Jun. 29, 2006

(30) Foreign Application Priority Data

Jul. 22, 2003 (JP) ..... 2003-199683

(51) Int. Cl.
*F01B 29/10* (2006.01)

(52) U.S. Cl. ..... 60/517; 60/520

(58) Field of Classification Search ..... 60/517, 60/519, 520; 62/6
See application file for complete search history.

(56) References Cited

U.S. PATENT DOCUMENTS

| | | | | |
|---|---|---|---|---|
| 5,003,777 | A * | 4/1991 | Berchowitz | 60/520 |
| 5,461,859 | A * | 10/1995 | Beale et al. | 60/517 |
| 5,537,820 | A * | 7/1996 | Beale et al. | 60/517 |
| 6,874,321 | B2 * | 4/2005 | Ogura | 60/520 |
| 7,000,390 | B2 * | 2/2006 | Wood | 60/520 |
| 7,007,469 | B2 * | 3/2006 | Bliesner | 60/517 |
| 7,017,344 | B2 * | 3/2006 | Pellizzari et al. | 60/517 |

FOREIGN PATENT DOCUMENTS

| | | | |
|---|---|---|---|
| JP | 2000-337725 | A | 12/2000 |
| JP | 2001-231239 | A | 8/2001 |
| JP | 2002-213831 | A | 7/2002 |
| JP | 2002-349347 | A | 12/2002 |
| JP | 2003-50058 | A | 2/2003 |
| JP | 2005172287 | A * | 6/2005 |

* cited by examiner

*Primary Examiner*—Hoang Nguyen
(74) *Attorney, Agent, or Firm*—Birch, Stewart, Kolasch & Birch, LLP

(57) ABSTRACT

A Stirling engine, wherein when a linear motor reciprocatingly move a piston in a cylinder, a displacer also reciprocatingly moves in the cylinder storing the displacer. By this, working mixture moves between a compression space and an expansion space. Though a spring for generating resonance is combined with the displacer, a spring for generating resonance for the piston is eliminated. Gas bearings are installed for the piston at two or more positions at specified intervals in the axial direction. An inside flange formed at the end of the cylinder and a stopper plate fixed to the linear motor determine the moving limit of the piston. Since a pin projected from the stopper plate is received by a through hole in a magnet holder, the piston can be prevented from being rotated.

3 Claims, 4 Drawing Sheets

| OUTPUT FACTOR | |
|---|---|
| INPUT (W) | (WITHOUT PISTON SPRING)/(WITH PISTON SPRING) |
| 60 | 0.983 |
| 80 | 0.976 |
| 100 | 0.970 |

STIRLING ENGINE

TECHNICAL FIELD

The present invention relates to a Stirling engine.

BACKGROUND ART

Using helium, hydrogen, nitrogen, etc. instead of CFCs as working gas, the Stirling engine has been attracting much attention as a heat engine that does not destroy the ozone layer. Examples of the Stirling engine are seen in Patent Publications 1 to 4 listed below.

Patent Publication 1: Japanese Patent Application Laid-open No. 2000-337725 (pages 2 to 4, FIGS. 1 to 4)

Patent Publication 2: Japanese Patent Application Laid-open No. 2001-231239 (pages 2 to 4, FIGS. 1 to 4)

Patent Publication 3: Japanese Patent Application Laid-open No. 2002-213831 (pages 3 to 4, FIG. 1)

Patent Publication 4: Japanese Patent Application Laid-open No. 2002-349347 (pages 5 to 6, FIGS. 1 to 4)

DISCLOSURE OF THE INVENTION

Problems to be Solved by the Invention

Research has been eagerly done on the Stirling engine for higher performance and lower cost.

In view of the foregoing, an object of the present invention is to reduce the number of components needed to build a Stirling engine, and thereby to simplify the structure and reduce the cost thereof.

Means for Solving the Problem

To achieve the above object, according to the present invention, a Stirling engine is structured as follows: in a Stirling engine including a displacer that moves working gas between a compression space and an expansion space and a piston that is made to reciprocate inside a cylinder by a driving force source, wherein the piston reciprocates to cause the displacer to reciprocate to cause the working gas to move, a spring for causing the piston to resonate is eliminated.

With this structure, no spring is used for the piston, and thus the number of components lessens. As the number of components lessens, the cost of components lowers, and in addition, since the piston no longer needs to be coupled to a spring, and thus it no longer needs a centering process, the cost of assembly also lowers. As the number of components lessens, the overall structure is simplified, and thus the incidence of failure lowers.

Moreover, according to the present invention, in the Stirling engine structured as described above, a gas bearing is formed between the outer circumferential face of the piston and the inner circumferential face of the cylinder, and two or more of the gas bearing are arranged at an interval from one another along the axis of the piston.

With this structure, since two or more gas bearings are arranged at an interval from one another along the axis of the piston, the piston, while reciprocating, does not incline with respect to the cylinder. Thus, the piston and the cylinder are securely prevented from making contact with each other, thereby preventing friction between them and what may result therefrom such as an energy loss and a wear at where they make contact.

Moreover, according to the present invention, in the Stirling engine structured as described above, rotation preventing means is provided for preventing the piston from rotating about the axis thereof inside the cylinder.

With this structure, the gas that serves as the gas bearing is supplied from the compression space and flows into a bounce space. To keep a proper pressure balance between the bounce space and the compression space, a return flow passage needs to be formed that leads from outside the cylinder through the cylinder to the compression space. So long as the piston does not rotate about the axis thereof inside the cylinder, the return flow passage securely plays its role, and moreover the pin holes forming the gas bearing are prevented from connecting to the return flow passage and thereby causing the gas bearing to fail to function properly.

Moreover, according to the present invention, in the Stirling engine structured as described above, movement restricting means is provided for limiting the range within which the piston can reciprocate.

With this structure, the piston, now liberated from restraint with a spring, can be prevented from popping out of the cylinder.

Moreover, according to the present invention, in the Stirling engine structured as described above, an elastic member for damping shock is arranged between the piston and the movement restricting means.

With this structure, even if the piston collides with the movement restricting means, the shock is alleviated so as to prevent noise and damage to the mechanism. As the elastic member, an O-ring, a commonly available mechanical component, can be used. This makes the elastic member easy and inexpensive to procure. Moreover, since an O-ring is highly resistant to unusual temperatures, oil, chemicals, etc., even when it is exposed to pressurized working gas inside a pressure vessel, it is unlikely to deteriorate.

Moreover, according to the present invention, in the Stirling engine structured as described above, a linear motor is used as the driving force source.

With this structure, the piston can be made to reciprocate highly efficiently without the use of a movement conversion mechanism such as a crank combined with a connecting rod.

LIST OF REFERENCE SYMBOLS

1 Stirling Engine
10, 11 Cylinder
12 Piston
13 Displacer (Movement Restricting Means)
14 Magnet Holder
20 Linear Motor
31 Spring (for Causing Resonance)
45 Compression Space
46 Expansion Space
50 Pressure Vessel
51 Bounce Space
70 Inner Flange (Movement Restricting Means)
71 Stopper Plate (Movement Restricting Means)

72 O-Ring (Elastic Member)
80 Void
81 Connection Opening
82 Pin Holes (for Forming Gas Bearings)
90 Fixed Return Flow Passage
91 Movable Return Flow Passage
92 Through Hole (Rotation Preventing Means)
93 Pin (Rotation Preventing Means)

BEST MODE FOR CARRYING OUT THE INVENTION

Figure 1:
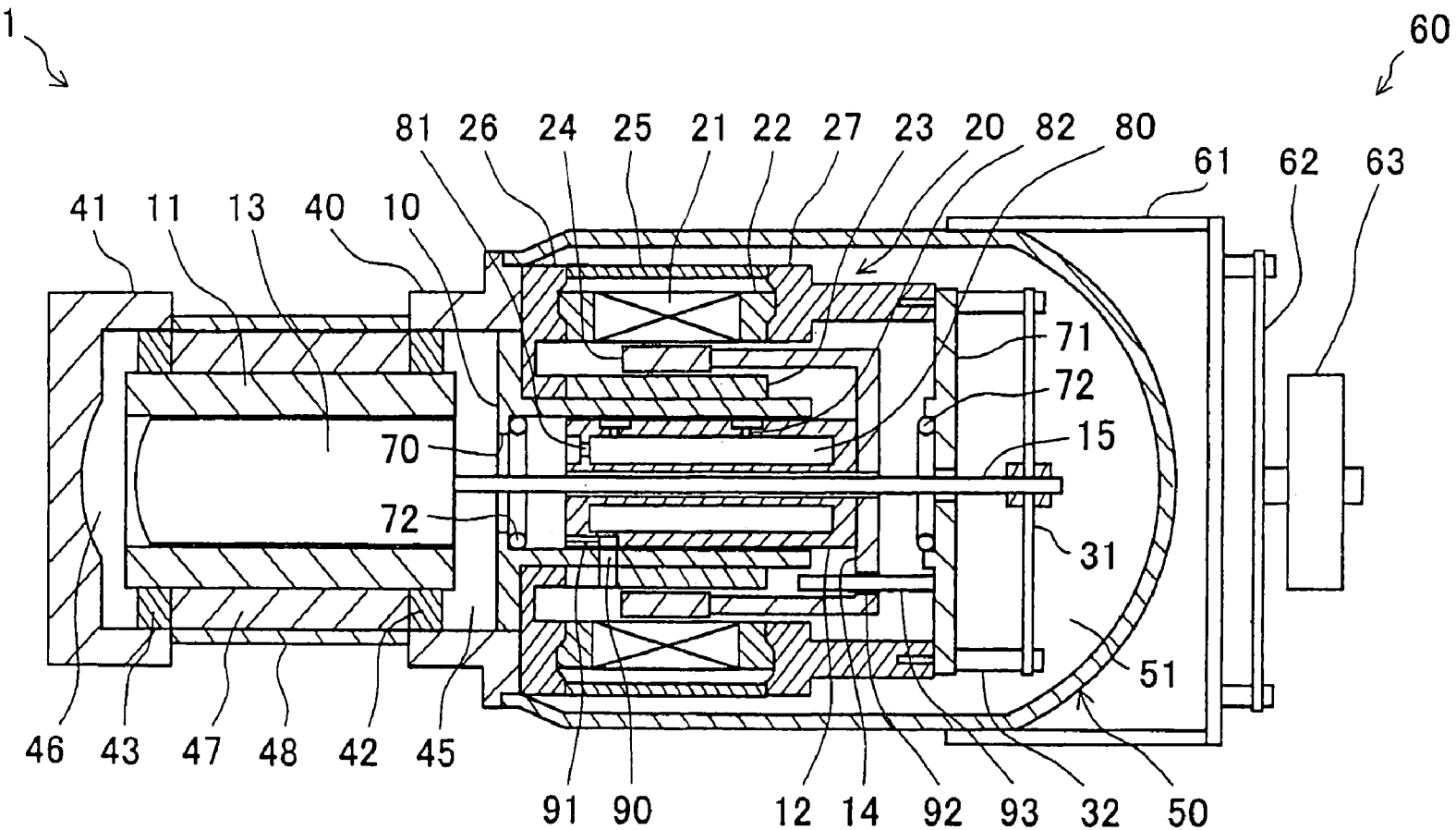
[FIG. 1] A sectional view of the Stirling engine of a first embodiment of the present invention.
Figures 2, 3:
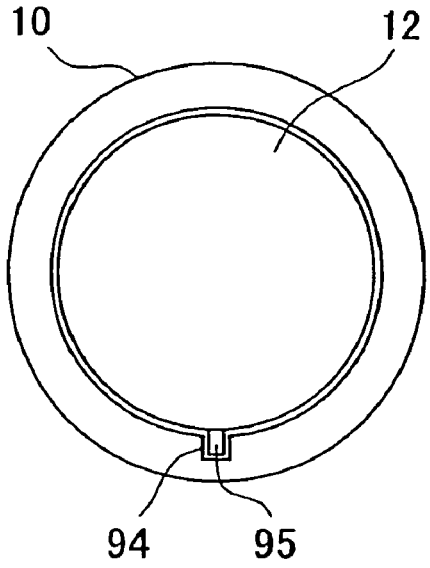
[FIG. 2] A table showing the result of performance tests.
[FIG. 3] A partial sectional view of the Stirling engine of a second embodiment of the present invention.

A first embodiment of the present invention will be described below with reference to FIGS. 1 and 2. FIG. 1 is a sectional view of the Stirling engine, and FIG. 2 is a table showing the results of performance tests.

The Stirling engine 1 is built around cylinders 10 and 11. The axes of the cylinders 10 and 11 run along the same straight line. A piston 12 is inserted into the cylinder 10, and a displacer 13 is inserted into the cylinder 11. The piston 12 and the displacer 13 move with a phase difference kept between them.

At one end of the piston 12, a cup-shaped magnet holder 14 is fixed. From one end of the displacer 13, a displacer rod 15 extends. The displacer rod 15 penetrates the piston 12 and the magnet holder 14 so as to be freely slidable.

The cylinder 10 holds a linear motor 20 outside the working space of the piston 12. The linear motor 20 includes: an outer yoke 22 fitted with a coil 21; an inner yoke 23 located in contact with the outer circumferential face of the cylinder 10; a ring-shaped magnet 24 inserted in an annular space between the outer yoke 22 and the inner yoke 23; a tubular member 25 that encloses the outer yoke 22; and end brackets 26 and 27, formed of synthetic resin, that holds the outer yoke 22, the inner yoke 23, and the tubular member 25 in a predetermined positional relationship. The magnet 24 is fixed to the magnet holder 14.

The displacer rod 15 is fixed to a central part of a spring 31. A peripheral part of the spring 31 is fixed to the end bracket 27 with a spacer 32 placed in between. The spring 31 is a disk-shaped flat member having a spiral cut formed therein, and serves to cause the displacer 13 to resonate with the piston 12 with a predetermined phase different kept between them.

Outside the part of the cylinder 11 that forms the working space of the displacer 13, a heat-conducting heads 40 and 41 are arranged. The heat-conducting head 40 is ring-shaped, and the heat-conducting head 41 is cap-shaped, of which both are formed of metal with high thermal conductivity such as copper or a copper alloy. The heat-conducting heads 40 and 41 are supported outside the cylinder 11 with ring-shaped inner heat exchangers 42 and 43, respectively, placed in between. The inner heat exchangers 42 and 43 are both air-permeable, and conduct the heat of the working gas passing trough the interior thereof to the heat-conducting heads 40 and 41. The heat-conducting head 40 is coupled to the cylinder 10 and to a pressure vessel 50.

The annular space enclosed with the heat-conducting head 40, the cylinders 10 and 11, the piston 12, the displacer 13, the displacer rod 15, and the inner heat exchanger 42 serves as a compression space 45. The space enclosed with the heat-conducting head 41, the cylinder 11, the displacer 13, and the inner heat exchanger 43 serves as an expansion space 46.

Between the inner heat exchangers 42 and 43, a regenerator 47 is arranged. The regenerator 47 also is air-permeable, and permits the working gas to pass through the interior thereof. The regenerator 47 is enclosed with a regenerator tube 48. The regenerator tube 48 forms an air-tight passage between the heat-conducting heads 40 and 41.

The linear motor 20, the cylinder 10, and the piston 12 are enclosed in the pressure vessel 50, which is cylindrical. The space inside the pressure vessel 50 serves as a bounce space 51.

The pressure vessel 50 is fitted with a vibration suppressor 60. The vibration suppressor 60 is composed of: a frame 61 that is fixed to the pressure vessel 50; a plate-shaped spring 62 that is supported on the frame 61; and a mass 63 that is supported on the spring 62.

Here, as opposed to in a common Stirling engine, no spring is provided that causes the piston 12 to resonate. This may cause the piston 12 to slip out of the cylinder 10, and, to prevent this, movement restricting means is provided that limits the range within which the piston 12 can reciprocate. In this embodiment, what serves as the movement restricting means on the compression space 45 side is an inner flange 70 formed at an end of the cylinder 10; what serves as the movement restricting means on the bounce space 51 side is a stopper plate 71 fixed to the end bracket 27 of the linear motor 20. So long as the piston 12 remains within this reciprocation range, the magnet 24 remains in a state in which it can be driven by the coil 21; that is, the magnet 24 remains present within the magnetic circuit of the linear motor 20.

The inner flange 70 receives the end face of the piston 12, and the stopper plate 71 receives the end face of the magnet holder 14. If these members actually collide with each other, noise and vibration are produced. To prevent this, an elastic member is arranged that damps shock. In this embodiment, as the elastic member, O-rings 72 are used. The inner flange 70 and the stopper plate 71 hold their respective O-rings 72 by the use of proper coupling means such as an adhesive. The O-rings 72 may instead be fitted oppositely, specifically to the piston 12 and the magnet holder 14.

The piston 12 has a void 80 inside. The void 80 leads to the compression space 45 via a connecting opening 81 formed in an end face of the piston 12. In the outer circumferential face of the piston 12, pin holes 82 are formed that lead to the void 80. The pin holes 82 form a gas bearing, with a plurality of them formed at predetermined angular intervals around one circumference. The pin holes 82 are formed around two or more circumferences located at an interval from one another; that is, two or more gas bearings are formed. In the embodiment illustrated, two gas bearings are formed. This, it should be understood, is not meant to limit in any way the number of gas bearings formed.

Apart from the pin holes 82, a return flow passage is formed that permits the gas inside the bounce space 51 to return to the compression space 45. The return flow passage is composed of: a fixed return flow passage 90 that is formed to penetrate the inner yoke 23 of the linear motor 20 and then the cylinder 10; and a movable return flow passage 91 that is formed to bend in an L-shape inside the piston 12.

When the cylinder 10 and the piston 12 are viewed from an end face thereof, the fixed return flow passage 90 and the movable return flow passage 91 need to be located at the same angular position. This means that the cylinder 10 and the piston 12 need to be always at the same angle relative to each other. To achieve this, rotation preventing means is provided that prevents the piston 12 from rotating about the axis thereof inside the cylinder 10. In this embodiment, a through hole 92 is formed in the magnet holder 14, and a pin 93 that protrudes from the movable return flow passage 91 is put through the through hole 92 to prevent the piston 12 from rotating. This also helps prevent one of the pin holes 82 from meeting the fixed return flow passage 90 and causing the gas bearing to fail to function properly.

How the Stirling engine 1 operates is as follows. When alternating electric current is supplied to the coil 21 of the linear motor 20, between the outer yoke 22 and the inner yoke 23, an electric field is produced that penetrates the magnet 24. Thus, the magnet 24 reciprocate in the axial direction. This causes the piston 12, which is coupled to the magnet 24 via the magnet holder 14, to also reciprocate.

As the piston 12 reciprocates, an even pressure variation occurs over the entire space on the left of the piston 12. Here, consider the pressures that act on the displacer 13. According to Pascal's principle, the pressure that acts on the expansion space 46 side end face of the displacer 13 and the pressure that acts on the compression space 45 side face thereof are equal, and thus cancel out each other. However, since the displacer rod 15 protrudes into the bounce space 51 on the right of the piston 12, the displacer rod 15 receives a back pressure commensurate with the cross-sectional area thereof.

Since the back pressure varies at the opposite phase to the pressure variation in the compression space 45, the pressures on both sides of the displacer 13 do not completely cancel out each other, but a pressure difference is produced. That is, as the piston 12 advances toward the displacer 13, the displacer 13 retreats toward the piston 12. As a result, the volume of the compression space 45 decreases, and the volume of the expansion space 46 increases. The amount of working gas corresponding to the decrease in the volume of the compression space 45 flows through the regenerator 47 into the expansion space 46.

On the other hand, as the piston 12 retreats away from the displacer 13, the displacer 13 advances away from the piston 12. As a result, the volume of the expansion space 46 decreases, and the volume of the compression space 45 increases. The amount of working gas corresponding to the decrease in the volume of the expansion space 46 flows through the regenerator 47 into compression space 45.

In this way, in a free-piston structure, the displacer 13 oscillates synchronously with the oscillation frequency of the piston 12. To efficiently keep this oscillation, the resonance frequency, which depends on the total mass of the displacer system (the displacer 13, the displacer rod 15, and the spring 31) and the spring constant of the spring 31, is so set as to be resonant with the drive frequency of the piston 12. This permits the piston system and the displacer system to oscillate synchronously with a predetermined phase difference kept properly between them.

The synchronous oscillation of the piston 12 and the displacer 13 produces a compression/expansion cycle. Properly setting the phase difference of the oscillation permits a large amount of heat to be produced by adiabatic compression in the compression space 45 and a large amount of cold to be produced by adiabatic expansion in the expansion space 46. Thus, the temperature in the compression space 45 rises, and the temperature in the expansion space 46 falls.

During operation, the working gas moves between the compression space 45 and the expansion space 46. When the working gas passes through the inner heat exchangers 42 and 43, the heat of the working gas conducts via the inner heat exchangers 42 and 43 to the heat-conducting heads 40 and 41. The working gas that jets out of the compression space 45 is hot, and the heat-conducting head 40 is heated. That is, the heat-conducting head 40 serves as a warm head. The working gas that jets out of the expansion space 46 is cold, and the heat-conducting head 41 is cooled. That is, the heat-conducting head 41 serves as a cold head. While the heat-conducting head 40 dissipates heat, the heat-conducting head 41 lowers the temperature in a given space, and in this way the Stirling engine 1 functions as a refrigerating engine.

The regenerator 47 does not conduct the heat in the compression space 45 to the expansion space 46 or vice versa, but simply permits the working gas to flow between them. What happens to the hot working gas that has flowed out of the compression space 45 via the inner heat exchanger 42 into the regenerator 47 is that, while the working gas is passing through the regenerator 47, the working gas rejects heat to the regenerator 47, so that the working gas is colder when it flows into the expansion space 46. What happens to the cold working gas that has flowed out of the expansion space 46 via the inner heat exchanger 43 into the regenerator 47 is that, while the working gas is passing through the regenerator 47, the working gas collects heat from the regenerator 47, so that the working gas is hotter when it flows into the compression space 45. That is, the regenerator 47 serves as a storehouse of heat.

Part of the pressurized working gas in the compression space 45 flows through the connecting opening 81 into the void 80 inside the piston 12, and then jets out via the pin holes 82. The working gas thus jetting out forms a film of gas between the outer circumferential face of the piston 12 and the inner circumferential face of the cylinder 10, and thereby prevents the piston 12 and the cylinder 10 from making contact with each other. A similar gas bearing is formed also between the displacer 13 and the cylinder 11.

Around the piston 12, two or more gas bearings are formed at an interval from one another in the axial direction. This prevents the piston 12 from inclining in the axial direction with respect to the cylinder 10 while reciprocating. Thus, the piston 12 and the cylinder 10 are securely prevented from making contact with each other, thereby preventing friction between them and what may result therefrom such as an energy loss and a wear at where they make contact.

As the piston 12 reciprocates continuously, the gas pressure in the bounce space 51 gradually increases, and upsets the pressure balance between the compression space 45 and the bounce space 51. This is prevented by the provision of the fixed return flow passage 90 and the movable return flow passage 91. Specifically, while the piston 12 reciprocates, the return flow passages 90 and 91 meet at given timing. At this timing, the gas returns from the bounce space 51 via the fixed return flow passage 90 and the movable return flow passage 91 to the compression space 45, so that a proper pressure balance is restored.

As described previously, the rotation preventing means, which is composed of the through hole 92 and the pin 93, prevents the piston 12 and the cylinder 10 from rotating relative to each other. This ensures that, while the piston 12 is reciprocating, the fixed return flow passage 90 and the movable return flow passage 91 meet at predetermined timing, and simultaneously ensures that none of the pin holes 82 meets the fixed return flow passage 90 and causes the gas bearing to fail to function properly.

As the piston 12 and the displacer 13 reciprocate, and the working gas moves, the Stirling engine 1 produces vibration. This vibration is suppressed by the vibration suppressor 60.

FIG. 2 shows the results of tests conducted to evaluate the performance of the Stirling engine structured as described above. In the tests, the same Stirling engine was operated with and without a piston spring, and the output it yielded without a piston spring was divided by the output it yielded with a piston spring to calculate the output factor. The tests revealed that the output factor was 0.983 at an input of 60 W, 0.976 at an input of 80 W, and 0.970 at an input of 100 W. The tests thus confirmed that the elimination of a piston spring little affected the output.

FIG. 3 shows a second embodiment of the present invention. The second embodiment relates to how the piston is prevented from rotating relative to the cylinder. FIG. 3 is a partial sectional view showing the relevant components alone.

In the second embodiment, in the inner face of the cylinder 10, a groove 94 is formed that extends in the axial direction, and, on the piston 12, a projection 95 is formed that engages with the groove. In this way, rotation is prevented.

Figure 4:
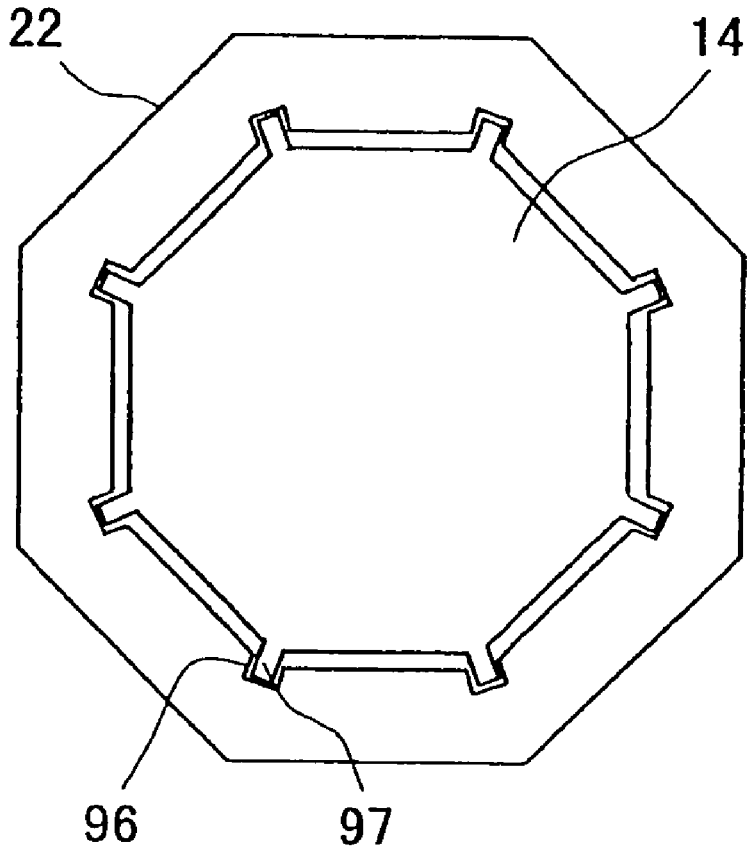
[FIG. 4] A partial sectional view of the Stirling engine of a third embodiment of the present invention.

FIG. 4 shows a third embodiment of the present invention. The third embodiment also relates to how the piston is prevented from rotating relative to the cylinder. FIG. 4 is a partial sectional view showing the relevant components alone.

In the third embodiment, the outer yoke 22 and the end brackets 26 and 27 are given a polygonal inner cross-sectional shape, for example octagonal as illustrated in the figure. In the inner corners of the octagonal shape, grooves 96 are formed that extend in the axial direction. Correspondingly, the magnet holder 14 is given an octagonal outer cross-sectional shape, and at the corners of the octagonal shape, projections 97 are formed that engage with the grooves 96. In this way, rotation is prevented.

Figure 5:
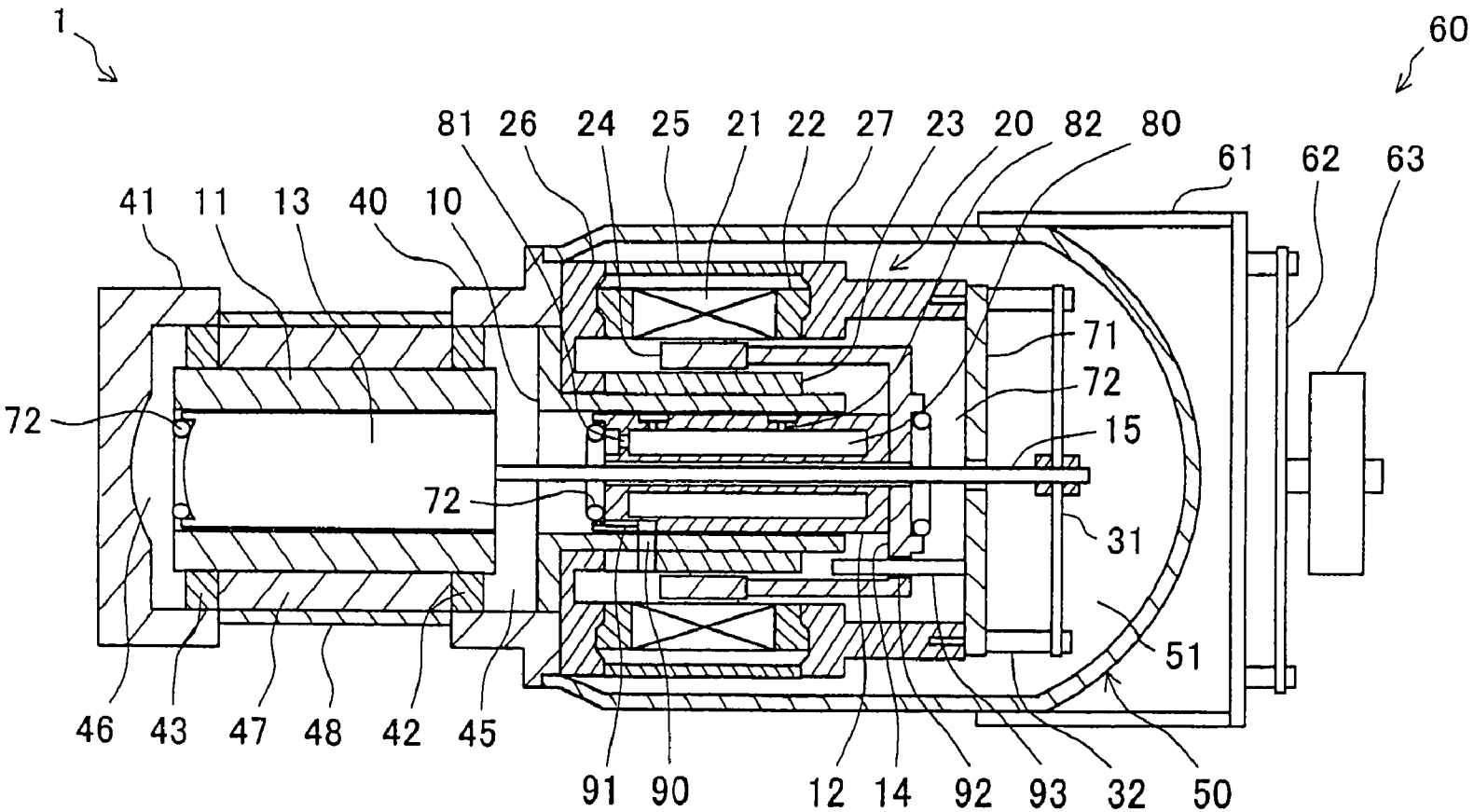
[FIG. 5] A sectional view of the Stirling engine of a fourth embodiment of the present invention.

FIG. 5 shows a fourth embodiment of the present invention. FIG. 5 is a sectional view of a Stirling engine. The Stirling engine of the fifth embodiment is composed of mostly the same components as that of the first embodiment. Accordingly, such components as are common to both embodiments are identified with the same reference numerals as those used in the first embodiment, and no explanations thereof will be repeated.

The Stirling engine 1 of the fourth embodiment differs from that of the first embodiment in the design of the movement restricting means that limits the range within which the piston 12 can move. In the compression space 45, the piston 12 and the displacer 13 face each other without being kept off each other with an inner flange formed in the cylinder 10 as in the first embodiment. That is, here, the displacer 13 itself serves as the movement restricting means. An O-ring 72 for damping shock is fitted on an end face of the piston 12. This O-ring 72 may be fitted on the displacer 13. In the bounce space 51, an O-ring 72 is fixed on the magnet holder 14.

In this embodiment, in the expansion space 46, an O-ring 72 for damping shock is fitted on an end face of the displacer 13. This is to cope with possible collision of the displacer 13 with the heat-conducting head 41. This O-ring 72 may be fitted on the heat-conducting head 41.

In this embodiment, if the piston 12 advances too far toward the displacer 13, it collides, via the O-ring 72, with the displacer 13 retreating toward the piston 12. This collision occurs before the magnet 24 hits the end bracket 26, and thus saves the linear motor 20 from damage.

It should be understood that the present invention may be practiced in any manner other than specifically described above as embodiments, and many modifications and variations are possible within the spirit of the present invention.

INDUSTRIAL APPLICABILITY

The present invention finds application in Stirling engines having a free-piston structure in general.

The invention claimed is:

1. A Stirling engine including a displacer that moves inside a cylinder between a compression space and an expansion space and a piston that is made to reciprocate inside a cylinder by a linear motor, the piston reciprocating to cause the displacer to reciprocate to cause working gas to move, the Stirling engine including no spring for causing the piston to resonate, wherein rotation preventing means is provided for preventing the piston from rotating inside the cylinder about an axis common to the piston and the cylinder.

2. A Stirling engine including a displacer that moves inside a cylinder between a compression space and an expansion space and a piston that is made to reciprocate inside a cylinder between the compression space and a bounce space by a linear motor, the piston reciprocating to cause the displacer to reciprocate to cause working gas to move, the Stirling engine including no spring for causing the piston to resonate, wherein movement restricting means is provided for setting a limit of movement of the piston toward the bounce space.

3. The Stirling engine of claim 2, wherein an elastic member for damping shock is arranged between the piston and the movement restricting means.

* * * * *